United States Patent [19]

Peterson et al.

[11] Patent Number: 4,479,523

[45] Date of Patent: Oct. 30, 1984

[54] MORTISE AND TENON JIG

[76] Inventors: Dale Peterson, 764 Grant St.; Dean Martin, 3401 Florida Dr., both of Loveland, Colo. 80537

[21] Appl. No.: 428,903

[22] Filed: Sep. 30, 1982

[51] Int. Cl.[3] ..... B27C 5/10

[52] U.S. Cl. ..... 144/144.5 R; 144/82; 144/87; 409/130; 409/182

[58] Field of Search ..... 409/130, 182; 144/27, 144/144 R, 144.5, 87, 82, 83, 84, 85, 198, 203, 204

[56] References Cited

U.S. PATENT DOCUMENTS 4,373,562 2/1983 Vernon ..... 144/144.5

*Primary Examiner*—W. D. Bray

*Attorney, Agent, or Firm*—Hugh H. Drake

[57] ABSTRACT

A patterning jig for use with a router has a flat template with space-opposed side margins joined by respective front and rear margins. A first opening through the template is spaced inwardly a predetermined distance from one of the side margins and is centered on a line running between those side margins inwardly from the front margin. Also formed in the template is a tongue centered on that line, disposed toward the other of the side margins from the opening and positioned between a pair of open spaces defined through the template. A flat guide projects downwardly from the template parallel to and spaced inwardly of the line from the front margin. Various other accessory components are discussed for expanding upon the facility of usage.

12 Claims, 12 Drawing Figures

MORTISE AND TENON JIG

The present invention pertains to a patterning jig. More particularly, it relates to an assembly for the shaping of mating mortises and tenons by use of a router.

For shaping joints that enable the mating of different parts used in the construction of furniture and the like, it often is convenient to employ a tool known as a router. In itself, the router includes a rotating bit with cutting blade edges formed on its sides and it includes some kind of bearing surface that may be used in association with a template in order to accurately guide the router. A specific form of router bit is shown in U.S. Pat. No. 4,168,730-Keller, along with a pair of templates which may be used in the construction of dovetail joints such as are conventionally found in joining together the walls of drawers. Representative of other template apparatus generally for this kind of use are U.S. Pat. Nos. 3,800,840-McCord, 3,789,892-Converse, 3,109,466-Jones, 4,074,736-Wolff and 3,223,132-Erne.

Several of the foregoing references appear to be adequate for achieving the formation of a series of dovetail joints, making use of a router bit specially formed to have cutting edges angled relative to the axis of rotation of the bit. However, their approaches are not particularly suitable for the making of straight-sided and accurately interfitting mortises and tenons. Others of the references involve approaches that require precision adjustment of the different parts of their assemblies. On the other hand, those that might avoid that objection do not allow for inherent accuracy in the respective postions of a mortise and a tenon that have to fit together. All too often, many joints formed by the use of such apparatus require that the ultimate gluing together of the parts be accomplished with the use of clamps that stabilize parts being joined. The need for that stabilization arises because the two different joint members do not fit together with sufficient minimums in tolerance variation.

A general object of the present invention is to provide a new and improved patterning jig which overcomes deficiencies in prior art apparatus and insures accurate joint formation.

Another object of the present invention is to provide a new and improved patterning jig that is economical and yet which enables the achievement of a high degree of accuracy in joint formation.

A further object of the present invention is to provide a new and improved patterning jig which is readily adaptable to the useful association therewith of a variety of accessory components, many of which can readily be made by the user to accommodate variations in materials or ultimate results to be achieved.

A patterning jig constructed in accordance with the present invention includes a flat template which has space-opposed side margins joined by respective front and rear margins. A first opening through the template is spaced inwardly a predetermined distance from one of those side margins and is centered on a line that runs between the side margins and is spaced inwardly from the front margin. A tongue formed in the template, centered on that line, is disposed toward the other of the side margins from the opening and is positioned between a pair of open spaces that are defined through the template. A flat guide projects downwardly from the template parallel to and spaced inwardly of that line from the front margin. Preferably, a variety of accessory components also may be included.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 1:
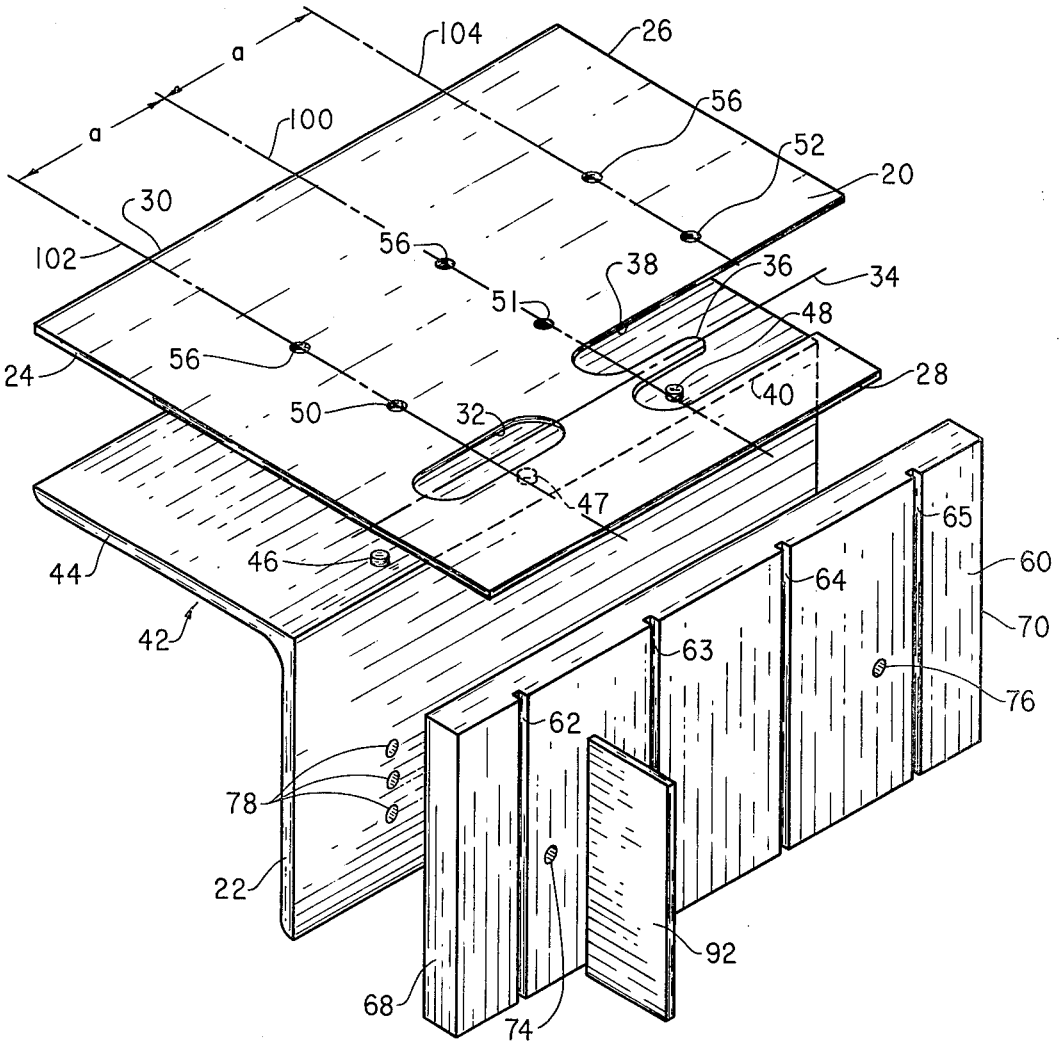
FIG. 1 is an exploded isometric view of apparatus embodying the present invention.
Figure 2:
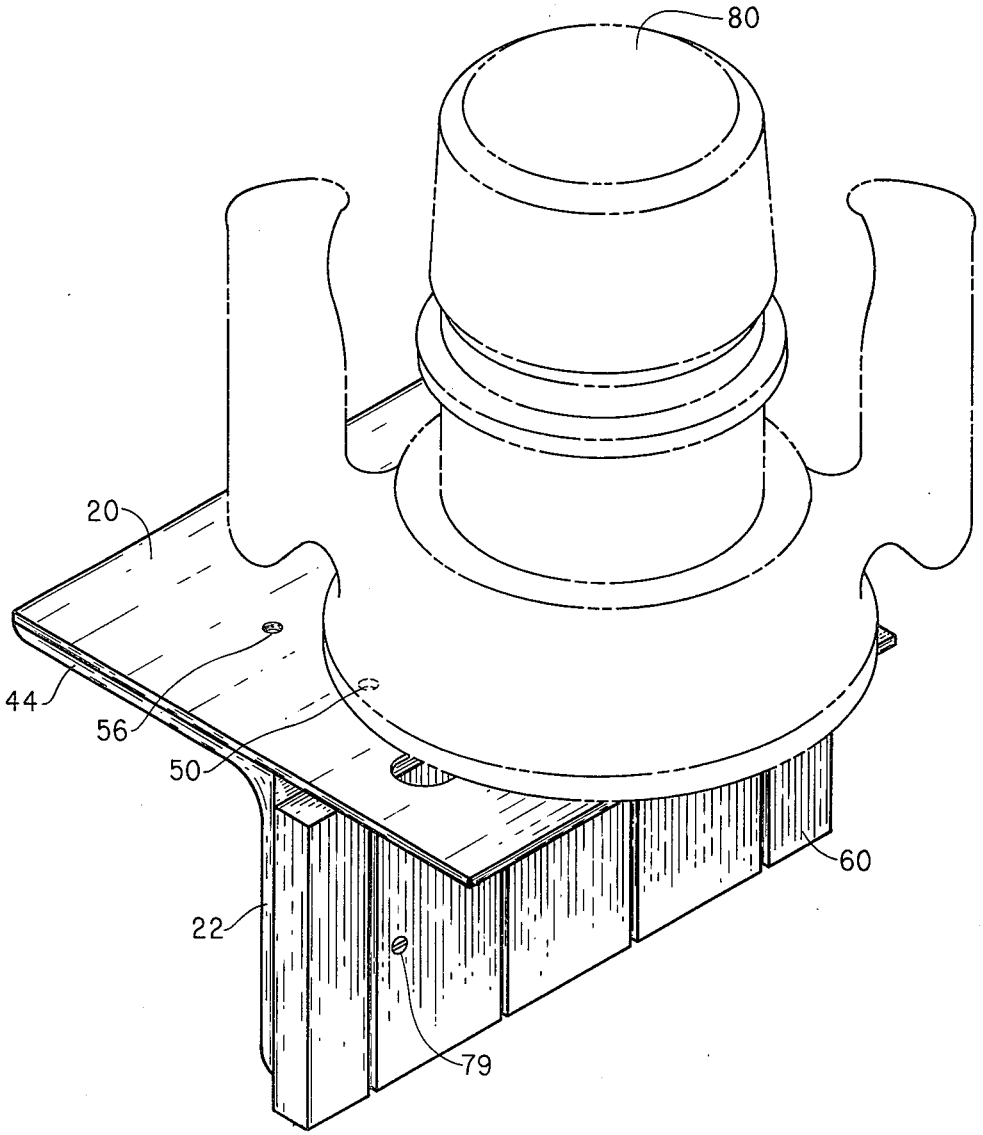
FIG. 2 is an isometric view of the apparatus as set up for use with a conventional router which is illustrated in dashed outline.
Figure 2A:
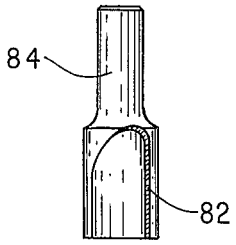
Figure 3:
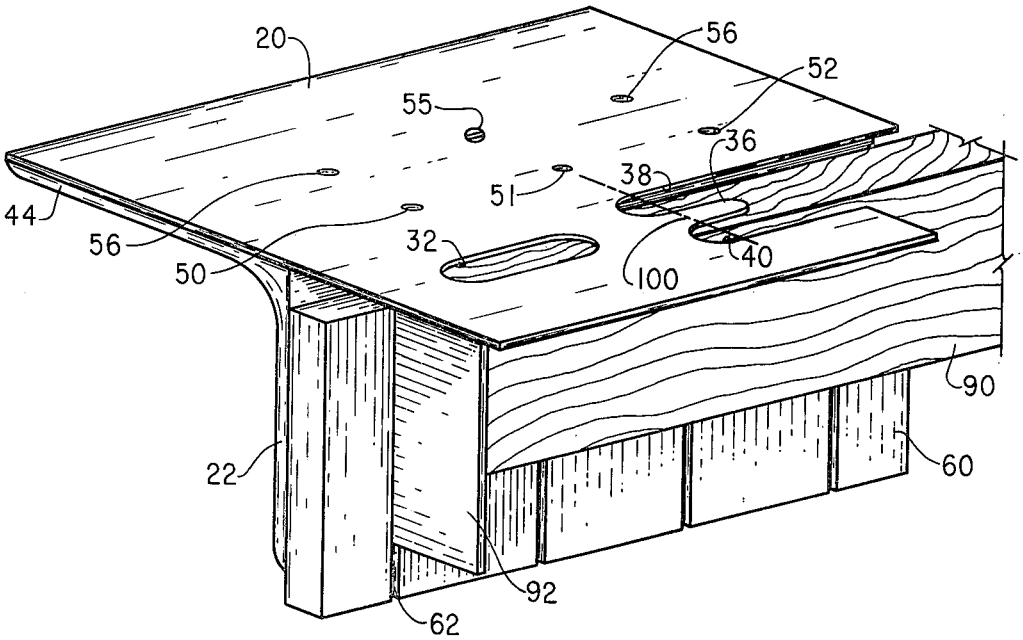
Figure 4:
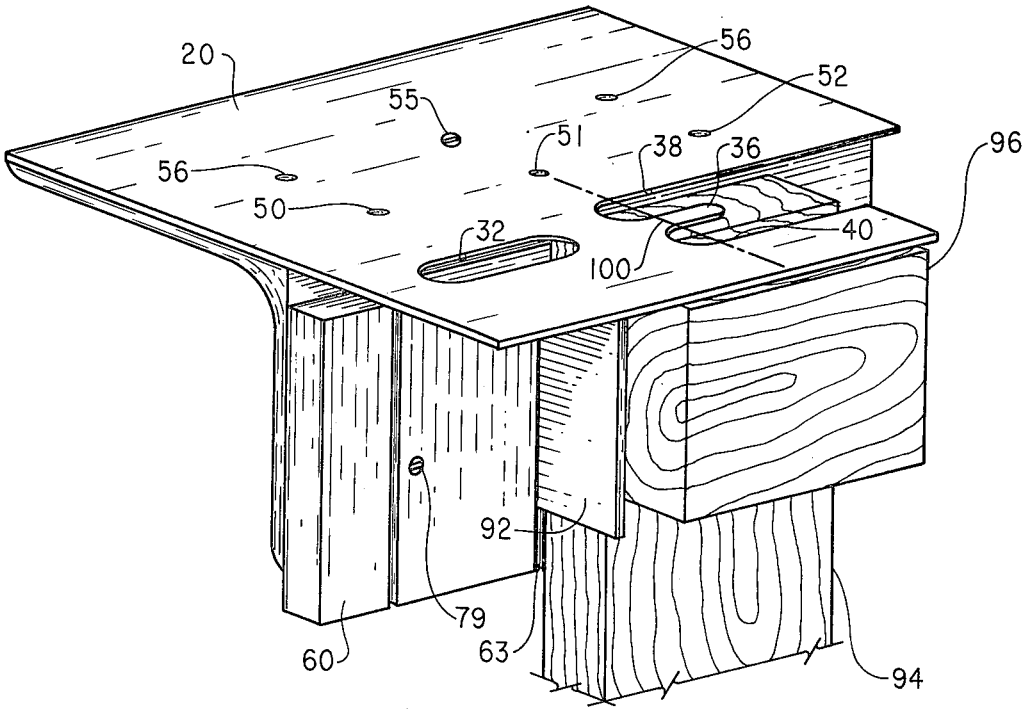
Figure 5:
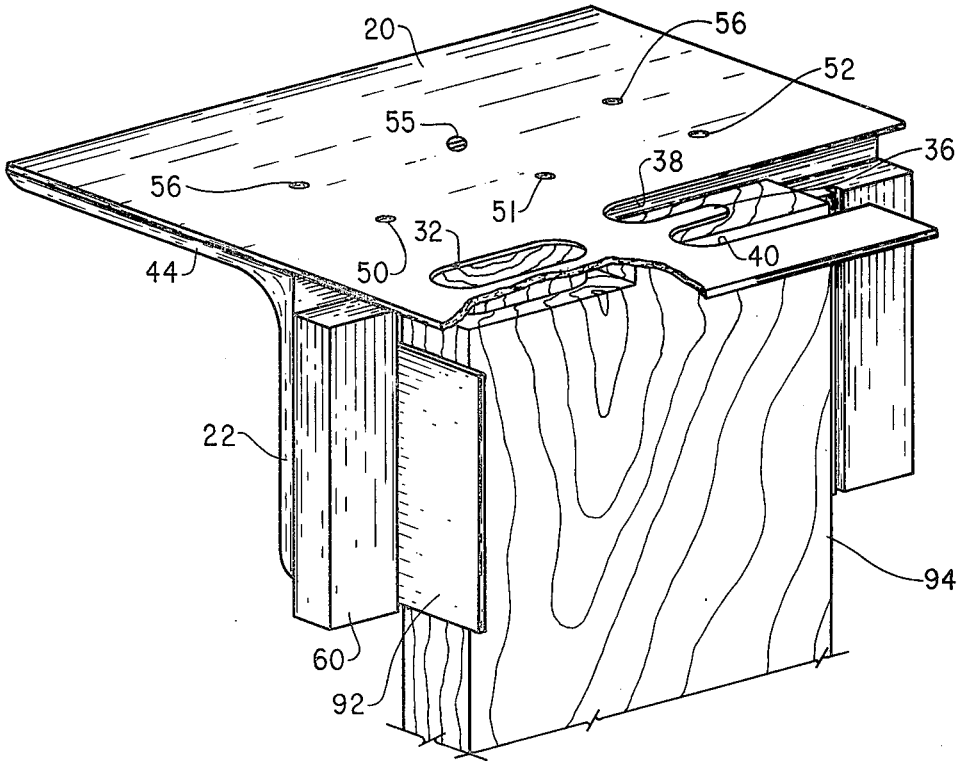
Figure 7:
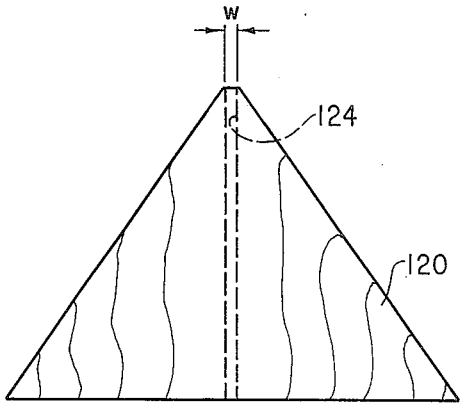
Figure 6:
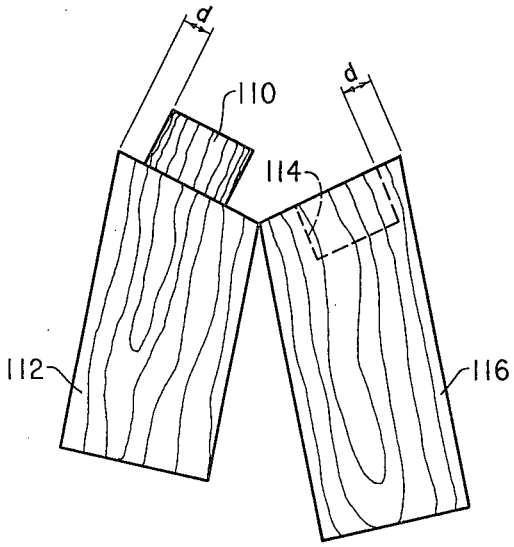
Figure 8:
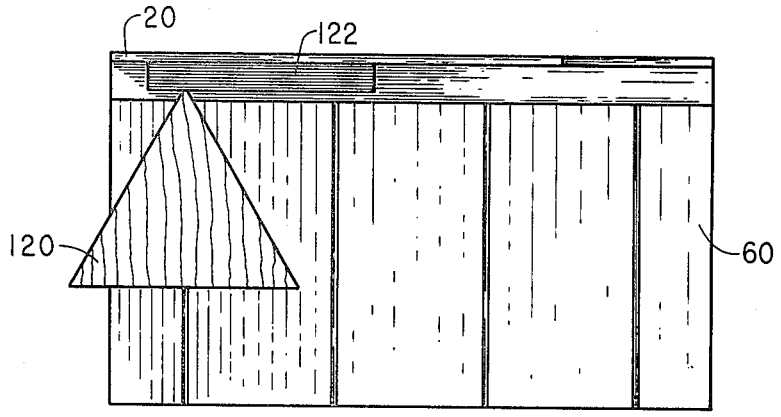
Figure 9:
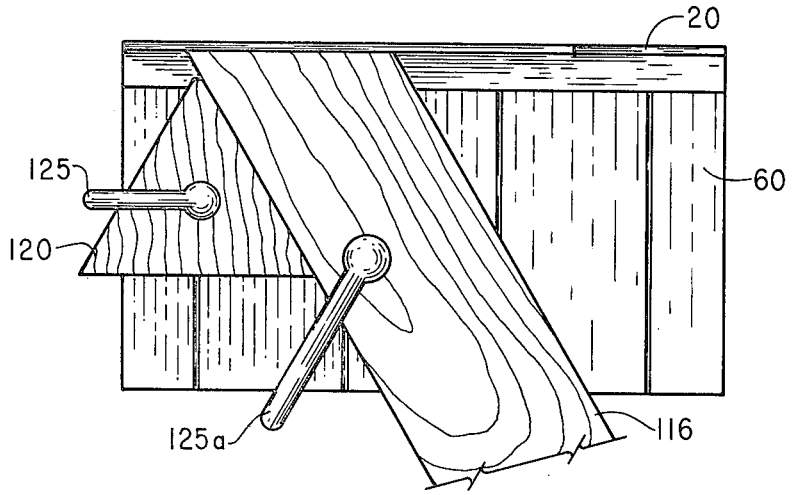
Figure 10:
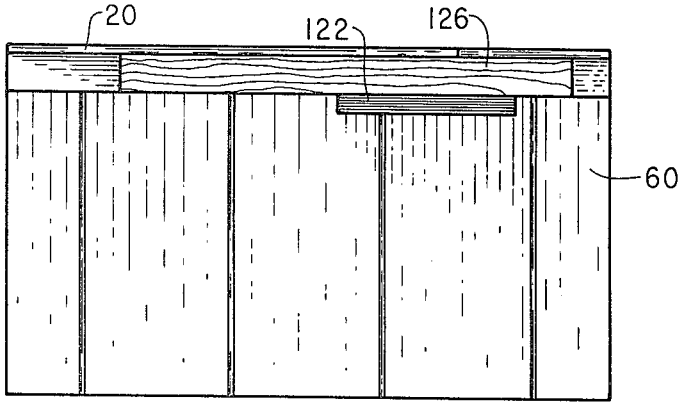
Figure 11:
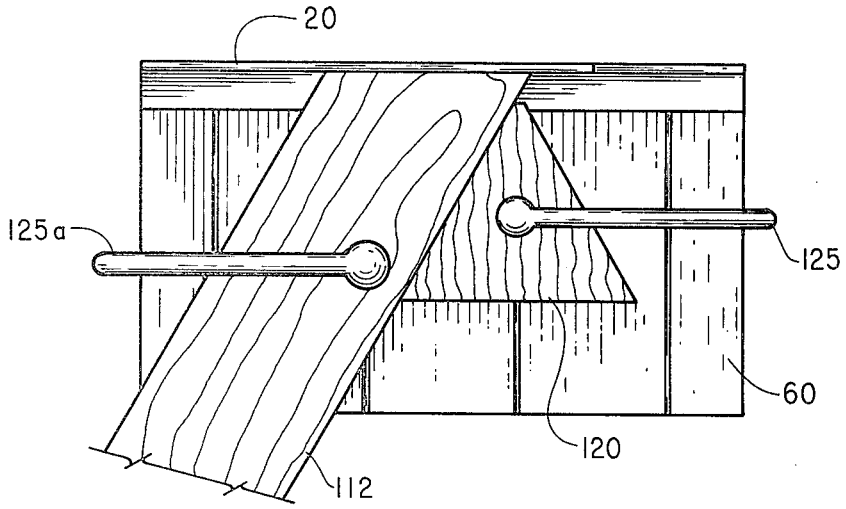

FIG. 2*a* is an isometric view of a conventional router blade;

FIG. 3 is a view of the assembly as set up for enabling the formation of a mortise in a structural member;

FIG. 4 is a view of the assembly as set up for the shaping of a tenon in a structural member;

FIG. 5 is a view similar to FIG. 4, partially broken away, but is set up for an alternative approach in the formation of tenons;

FIG. 6 is a view of components in which shaping is to be accomplished with use of the assembly in a particular manner;

FIG. 7 is a front elevational view of a guide or stop block used to facilitate one mode of use of the apparatus;

FIG. 8 is a diagramatic view of a variable in manner of use of the basic assembly;

FIG. 9 is another diagramatic view with respect to that mode of use;

FIG. 10 is still another diagramatic view illustrating a mode of approach related to that discussed in connection with FIGS. 7–10; and FIG. 11 is one more diagramatic view illustrating the approach discussed with respect to FIG. 9.

The patterning jig is basically composed of only two components, a flat template 20 and a guide 22. Template 20 has space-opposed side margins 24 and 26 joined by respective front and rear margins 28 and 30. A first opening 32 through template 20 is spaced inwardly a predetermined distance from side margin 24 and is centered on an imaginary line 34 that runs between side margins 24 and 26 and is spaced inwardly from front margin 28. Also formed in template 20 is a finger or tongue 36 that also is centered on line 34. It is disposed toward side margin 26 from opening 32 and is positioned between a pair of open spaces 38 and 40 that are defined through template 20. The long, straight sides of opening 32 are aligned with the respective longitudenal centerlines of open spaces 38 and 40.

Guide 22 is flat and projects downwardly from template 20 as part of an L-shaped base 42. Guide 22 is oriented so as to be parallel to and spaced inwardly of line 34 from front margin 28.

Base 42 is precisely formed to allow its horizontal leg 44 to seat against the underside of template 20 and insure that guide 22 projects downwardly in orthogonal relationship. Spaced apart on base 44, between its side margins, are three upwardly projecting pins 46, 47 and 48 that are correspondingly receivable with precision as set within any one of a series of apertures 50, 51 and 52 disposed in template 20 correspondingly between its side margins. A hole (not visible) in the center of leg 44 accepts a fastener threaded from the bottom into a corresponding one of a laterally-spaced series of holes 55 and 56, so as to secure with repeatable accuracy the assembly of template 20 on base 42 with opening 32 and tongue 36 cantilevered outwardly in front of guide 22.

Preferably also included is an elongated flat stage 60 that seats against guide 22 beneath template 20 and includes a plurality of constant-width vertical grooves 62–65 which are spaced in succession between the opposite ends 68 and 70 of stage 60. In this case disposed along the length of stage 60 are a pair of openings 74 and 76 that mate with selected ones of respective spatially-displaced threaded holes 78 distributed in a vertical direction in guide 22. That allows a fastener 79 to be used to secure stage 60 to the front face of guide 22 with a selected spacing below template 20.

With the basic parts assembled as in FIG. 2, a conventional router 80 is first mounted to insert its bit through opening 32 or one of spaces 38 and 40. Adjustment of the router bit, together with adjustment of the position of stage 60, is made to insure that the bottom of the bit is aligned with the top edge of the stage and the desired depth of cut is obtained.

FIG. 2*a* depicts a typical router bit that has a cutting portion 82 and a guide shank 84. Preferably, holes 78 are so spaced that stage 60 may be set at any of the distances of $\frac{1}{2}$, $\frac{3}{4}$ or 1 inch away from the undersurface of template 20. Holes 74 and 76 are spaced slightly off center so that, when stage 60 is turned over, that spacing becomes $\frac{5}{8}$, $\frac{7}{8}$ and $1\frac{1}{8}$ inch or inches. Desirably, markings are made on stage 60 in order to indicate those adjustments. As will become apparent, such adjustment ultimately determines the depths of different forms to be shaped. It may also be noted that stage 60, preferably constructed of wood, also serves another purpose of being a backing block that prevents undesired tearing out of wood being shaped during the cutting of tenons.

As an overall general description of use, a mortise is formed in the side edge of a board 90 (FIG. 3) by placing the board against stage 60 and the underside of template 20. Inserting router bit 82 into opening 32 enables the formation of a mortise into the side of board 90. As shown in FIG. 3, the left end of board 90 is positioned against a stop 92 which is in the form of a wooden board or stick which seats snugly in groove 62. This arrangement enables the mortise to be formed, as usually is desired, with its longitudinal direction along the grain of the wood. As illustrated, grooves 62–65 and stop 92 are rather narrow, the width of two U.S. pennies for convenience. It appears to be preferable, however, to make those widths about $\frac{1}{4}$ inch and to make stop 92 in the shape of an elongated stick that is easier to handle and functions more rigidly as a stop.

Again generally, a tenon may be formed in the end of another board member 94 by placing that member beneath tongue 36 as shown in FIG. 4 and once more against stop 92 in this case seated in groove 63. Router bit 82 is inserted into spaces 38 and 40 and run around the exposed surfaces of tongue 36. Approximately half of a tenon is thereby formed on the end of board 94. With a subsequent reversal of the parts, to be further discussed, the remainder of the tenon is formed by use of the router bit extending downwardly and alongside tongue 36.

In usage as shown in either FIGS. 3 or 4, it is preferred that, prior to actually performing the shaping, the workpiece or board, in this case 90 or 94, be securely held in place by use of a C-clamp applied between thet back side of guide 22 and a backing block 96 as specifically illustrated in FIG. 4.

It may be noted at this point that the provision of stage 60 is not necessary for a degree of utility in a combination of only template 20 and guide 22. Instead, the workpiece or board may be disposed directly against guide 22 after the latter has been suitably positioned with respect to opening 32 and tongue 36. In that case, however, extremely careful measurements on the workpieces must be made to insure that the parts ultimately will be aligned mutually as intended. As now will be discussed, additional attention to detail and dimensioning and relative orientation serves to "fool proof" ultimate usage.

Opening 32 is assigned a width in the direction transverse to line 34 that snugly receives router shank 84 in order to position bit 82 exactly with respect to line 34 when forming a mortise in a workpiece located beneath opening 32. Shank 84 desirably may be in the form of a bushing as shown, for example, in the aforementioned Keller patent. At the same time, the width of tongue 36 is chosen so that, in shaping a tenon on a different workpiece, that tenon has to be mateable precisely with a mortise formed in the first member. That is, board 94 as shown in FIG. 4 is so located beneath tongue 36 that, when bit 82 is received within spaces 38 and 40 successively during tenon formation, there is precise alignment with respect to an earlier or later formed mortise. To cooperate with shank 84, or a bushing thereon or any other similar bearing surface formed on the bit assembly, the width of opening 32 is coordinated with the width of each of open spaces 38 and 40, so that exactly the same mortise and tenon widths result.

The base of tongue 36 is located midway along line 34 between side margins 24 and 26, and on a symmetry line 100. In a rudimentary utilization, that permits the formation of one part of the tenon, after which workpiece 94 may be turned around so as to permit completion of the tenon. Preferably, however, workpiece 94 is left clamped into position as originally mounted, and template 20 is flipped over side-for-side. Because the base of tongue 36 is centered, that allows completion of the tenon with a high degree of accuracy. Locating pins 46, 47 and 48 are symmetrically disposed with respect to such a midpoint as are apertures 50, 51 and 52 and holes 56.

In more detail, pins 46, 47 and 48, apertures 50, 51 and 52 and holes 56 all are spaced apart, in respective succession, by a distance "a". Moreover, aperture 50 is aligned with a hole 56 on a line 102 that bisects opening 32. Aperture 51 and another hole 56 are located on line 100. Aperture 52 and the remaining hole 56 are on a line 104 which is symmetrically disposed about line 100 from line 102. Thus, template 20 may be mounted on template 20 in any of three possible positions when in one orientation and in three more if flipped over.

When tongue 36 is placed across symmetry line 100, a first half of a tenon may be formed. Simply flipping template 20 allows completion of the tenon. The working part of tongue 36 is that which projects over line 100. The base end of tongue 36, on the other side of line 100, accomodates a run-over of the router blade to insure a smooth mating of the two halves that are formed to make a complete tenon.

Mortising opening 32 is so sized that the router blade will cut a mortise the same size as the tenon formed by using tongue 36 as a pattern. As embodied, template 20 allows the forming of mortises or tenons one-half inch apart. Relating that to the distance "a" and a mortise length of "T", $T/2+\frac{1}{2}+T/2=a$.

It may be observed that another tongue and open-space arrangement could be oriented in the reverse direction on the same template. While that could avoid having to flip the template while still achieving accuracy, it would undesirably add to expense and size. Merely flipping template 20, as perferred, still maintains accurate alignment of both opening 32 and tongue 36 relative to line 34. As shown, spaces 38 and 40 define respective slots disposed alongside tongue 36 and effectively continue beyond tongue 36 toward side margin 26. While that side margin could be closed, the illustrated structure is believed to be more convenient for use of the router.

Grooves 62–65 are symmetrically distributed on respective opposite sides of a midpoint aligned with line 100 between the ends 68 and 70 of stage 60. Successive ones of those grooves are located outwardly from the respective opposing ends of opening 32 by a predetermined distance which represents the desired mortise-to-edge spacing obtained in use from shaping a mortise through opening 32. Analogously, all grooves are spaced outwardly beyond the tip of tongue 36 by a predetermined distance which represents the desired tenon-to-edge spacing obtained when used in shaping a tenon through spaces 38 and 40.

The arrangement illustrated not only allows template 20 to be flipped over for the completion of the cutting of the tenons, but it also allows for the shaping and spacing of double or triple mortise and tenon joints. Those are the kind of joints formed in the ends of wider structural members as appear to be preferred by craftsmen, as contrasted with the formation of a single tenon that is very long in comparison with its width. Grooves 62–65, in combination with stop board 92, are so aligned relative to the locations of opening 32 and tongue 36 to allow both the mortises and the tenons to be spaced $\frac{1}{2}$ inch away from that board and, thus, $\frac{1}{2}$ inch from the edge of the workpiece. Moreover, the spacing between the different ones of grooves 62–65 is such as to allow the formation of highly accurate double-M and double-T joints or triple joints by the same approach. Adding to versatility in an unusual case of having to form a mortise in a surface where the illustrated jig can't reach, a separate plate may be provided with an opening similar to opening 32 that can be clamped into the necessary location.

The exact embodiment illustrated has dimensions selected for use with a commercially available hand-tool-type router in which shank (or bushing) 84 has a diameter or 7/16 inch and bit 82 is of a $\frac{1}{4}$ inch straight-face kind. It is to be noted, in connection with use of the apparatus, that such a bit may not be exactly centered in an included bushing or shank. To maintain accuracy as between a tenon formed to mate with a given mortise, it is recommended that all shaping be done without turning the router on template 20. Moreover, it is important to make sure that the bit is still of the selected diameter intended to go along with the width dimensions incorporated into template 20. Resharpening of the bits may result in an insufficient degree of perfection. Absent a significant disparity, however, it will be found that the joints will fit together sufficiently well to enable gluing without the use of any subsequent clamping.

In use, the board is normally clamped to the vice as shown in FIG. 3 for forming of the mortise, and the other board is similarly clamped in the vice as shown in FIG. 4. Backing blocks are desired to insure against either tearing out of wood or the making of surface markings via the use of C-clamps. The operator is advised to mark all outwardly-facing surfaces ultimately to be shown, just to avoid possible subsequent confusion during assembly. In beginning the shaping of any mortise, the router should first be tipped toward its ultimate position with observation of the cutting operation. After the mortise is first started, it is preferred for ultimate accuracy that all cuttings be removed before completing the formation of the mortise.

The location of grooves 62–65 is deliberately chosen, so that stop plate 92 pre-spaces the workpiece such that the distance between the ultimate mortise and the end of the board is $\frac{1}{2}$ inch. When a double or triple mortise is to be formed, template 20 is simply flipped and/or stop board 92 is moved over one slot. In setting up for the shaping of a tenon, it is to be noted that the location of the grooves again is such that the distance between the tenon and the edge of the workpiece is $\frac{1}{2}$ inch. When it is desired to form a double or triple tenon, the grooves are so located relative one to another that it is only necessary to move the template over one pin at which time the workpiece remains positioned. Once completed, such a double or triple tenon will exactly fit into a double or triple mortise, respectively. In taking advantage of the symmetry provided as between the location of the opening, the spaces in the template and the grooves on the stage, it is to be noted that the workpiece always is to be clamped to the more central side of stop board 92.

The arrangements illustrated also lend themselves well to the making of other than right-angle joints, including joints that may be at any random angle. An example of such a random angle joint is illustrated in FIG. 6 wherein a tenon 110 is to be formed on the end of a workpiece 112 for the purpose of mating with a mortise 114 shaped into another member 116. A problem with such a joint is that the mortise must be spaced inwardly in an amount sufficient, in terms of the depicted distance d, that the mortise is not cut through the outer edge of member 116. That and similar problems are avoided by the use of one or more shims and an angled stop block 120 as shown in FIG. 7. All those additional accessory components preferably are made at the job site by the workman.

As shown in FIG. 8, a gapping board 122 is kept from scrap to define a spacer whose thickness equals the depth of cut made by router bit 82. Gapping board 122 is snugged into or in front of the gap formed between template 20 and stage 60. Double-angled stop block 120 is fabricated at the same time that the wood members to be joined are cut. Again, it may be simply a piece of scrap. A longitudinal groove 124 is cut into block 120 at a suitable depth which, for the sizes involved, might simply by approximately $\frac{3}{8}$ inch deep and of the same width as the grooves in stage 60.

To set up for joint formation at an arbitrary angle, gapping board 122 is chosen so as to accommodate the distance d shown in FIG. 6. Block 120 is mounted against the stage and up against gapping board 122, whereupon block 120 is secured by a clamp 125 (as in FIG. 9) into place and gapping board 122 is removed. At this point, it is only necessary to secure board 116 in place by another C-clamp **125*a* as shown in FIG. 9 and form the mortise. When a double or triple mortise is desired, template 20** is simply moved over one pin.

The corresponding tenon is analogously made. In this case, it is necessary first to insert an additional gapping board 126 between template 20 and stage 60, with board 122 spaced therebeneath as shown in FIG. 10. Gapping board 126 has a thickness equal to the desired depth of tenon 110. In using gapping boards, stop block 120 is snugged up against gapping board 122. After block 120 has been clamped into place, both gapping boards 122 and 126 are removed. In placing board 112 in appropriate position, tenon 110 is formed in the manner previously described. Once more, the formation of a double tenon, if desired, is achieved by subsequently moving template 20 to the next successive pin. It may be noted that, whenever moving stop block 120 for making a double or triple joint, the overall geometry is such that block 120 should never be moved so that board 112 or board 116 is positioned farther from the center of stage 60 than is block 120.

It will be observed that spacer or gapping board 122 serves as a memory. No markings are necessary on the workpiece itself. Even with the use of stop block 120, the results are accurate, because that block is cut with the same saw used to cut the workpieces themselves. That is, there is no error added by the jig.

Once the craftsman becomes familiar with use of the jig assembly first for the shaping of simple right-angle joints and then for the shaping of random angle joints, other available variations in use will become apparent. For example, compound angles, may be readily formed. Those are angles which require that, for completion, the workpieces be tilted away from the plane of stage 60. For that purpose, a wedge is made. Such a wedge is placed against the stage and marked so that grooves may be cut thereinto for enabling a positioning of the stage by the use of shims. When a very steep wedge angle is needed, it is preferred to cut the wedge and mount it first to guide 22 after which stage 60 is mounted on top of the wedge. In such an application, care must be taken to insure that both symmetry and alignment are heeded. In time, the user will probably collect a "library" of various wedges, stop blocks, gapping boards and shims, each labeled as to their specific use and the angles formed.

A rather structurally simple assembly has been described with appropriate detail as to dimensioning and relative orientation of the different components. It, nevertheless, is extremely versatile in connection with the formation of a variety of joints that have respectively different angles. At the same time, the inherent approach is that of assuring the accurate fit of mating parts and with tight tolerances.

While a particular embodiment of the invention has been shown and described in detail, and various modifications and alternatives have been described and discussed, it will be obvious to those skilled in the art that changes and modifications may be made without departing from the invention and its broader aspects. Therefore, the aim in the appended claims is to cover all such changes and modifications as fall within the true spirit and scope of that which is patentable.

We claim:

1. A patterning jig comprising:

a flat template having space-opposed side margins joined by respective front and rear margins;

means defining a first opening through said template spaced inwardly at a predetermined distance from one of said side margins and centered on a line running between said side margins and spaced inwardly from said front margin;

a tongue formed in said template, disposed toward the other of said side margins from said opening and positioned between a pair of means defining open spaces defined through said template, said tongue being centered on said line;

a flat guide projecting downwardly from said template parallel to and spaced inwardly of said line from said front margin;

said opening having a predetermined width in the direction transverse to said line with said width being selected to receive a router bit guide element and to position the router bit on said line for forming a mortise in a first member located between said opening;

and in which the width of said tongue in said direction is selected for shaping a tenon, matable with said mortise, on a second member located beneath said finger upon receipt of said element successively in said open spaces and engagement of said second member with said bit.

2. A jig as defined in claim 1 in which the width of said opening in the direction transverse to said line equivalent to the width of each of said open spaces in said direction.

3. A jig as defined in claim 1 in which the base of said tongue is located midway along said line between said side margins.

4. A jig as defined in claim 1 in which each of said spaces defines a slot disposed alongside said tongue and effectively continuing beyond said tongue toward said other side margin.

5. A jig as defined in claim 1 which includes means for removably mounting said template in fixed position with respect to said guide.

6. A jig as defined in claim 5 in which said mounting means enables flipping said template, side-for-side, with the alignment and location of said line with respect to said guide retained.

7. A jig as defined in claim 1 which further includes an elongated flat stage seatable against said guide beneath said template, said stage having a plurality of constant-width vertical grooves spaced in succession between the opposite ends of the stage.

8. A jig as defined in claim 7 in which said grooves are symmetrically distributed on opposite sides of a midpoint of the symmetry defined by the locations of said opening and said tongue.

9. A jig as defined in claim 7 which includes means for mounting said stage in a selectively fixed location with respect to said guide and said template.

10. A jig as defined in claim 7 in which successive ones of said grooves are located outwardly from respective opposing ends of said opening by a predetermined distance which represents a desired mortise-to-edge spacing obtained in use when shaping a mortise through said opening.

11. A jig as defined in claim 7 which also includes a stop block secured to said stage on the side thereof opposite said guide and presenting a flat surface normal to said stage and slanted at an angle with respect to said grooves.

12. A jig as defined in claim 7 in which all of said opening, tongue and grooves are mutually oriented about a common centerline.

* * * * *

UNITED STATES PATENT OFFICE

CERTIFICATE OF CORRECTION

Patent No. 4,479,523 Dated October 30, 1984

Inventor(s) Dale Peterson and Dean Martin

It is certified that error appears in the above-identified patent and that said Letters Patent are hereby corrected as shown below:

Column 8, Line 15: Cancel "between" and substitute -- beneath --.

Column 8, Line 20: Cancel "finger" and substitute -- tongue --.

Column 8, Line 24: After "line", substitute -- is --.

Signed and Sealed this

Thirtieth Day of April 1985

[SEAL]

*Attest:*

DONALD J. QUIGG

*Attesting Officer*

*Acting Commissioner of Patents and Trademarks*